United States Patent [19]

Engalitcheff, Jr.

[11] Patent Number: 4,768,783

[45] Date of Patent: Sep. 6, 1988

[54] APPARATUS FOR THE REHABILITATION OF DAMAGED LIMBS

[75] Inventor: John Engalitcheff, Jr., Gibson Island, Md.

[73] Assignee: Baltimore Therapeutic Equipment Co., Hanover, Md.

[21] Appl. No.: 900,242

[22] Filed: Aug. 26, 1986

Related U.S. Application Data

[60] Continuation of Ser. No. 666,636, Oct. 31, 1984, abandoned, which is a division of Ser. No. 393,241, Jun. 29, 1982, abandoned, which is a continuation-in-part of Ser. No. 99,838, Dec. 3, 1979, Pat. No. 4,337,050.

[51] Int. Cl.[4] ..... A63B 23/00

[52] U.S. Cl. ..... 272/143; 272/132; 272/130; 272/DIG. 5; 272/129; 128/25 R

[58] Field of Search ..... 272/67, 68, 117, 129, 272/130, 131, 132, 134, 143; 403/328; 128/25 R

[56] References Cited

U.S. PATENT DOCUMENTS

| | | | |
|---|---|---|---|
| 814,020 | 3/1906 | Clifford | 403/328 |
| 887,116 | 5/1908 | Palmer | 403/328 |
| 2,777,439 | 1/1957 | Tuttle | 272/132 |
| 3,495,824 | 2/1970 | Cuinier | 272/134 |
| 3,845,756 | 11/1974 | Olsson | 272/129 |

*Primary Examiner*—Leo P. Picard

*Attorney, Agent, or Firm*—James J. Brown

[57] ABSTRACT

Apparatus for simulating the operational characteristics of different tools in the rehabilitation therapy of damaged limbs by simultaneously carrying out, in coordinated fashion, several muscle and joint movements, which comprises:

(a) an angularly adjustable shaft mounted for full rotation in either direction about a fixed axis;

(b) a rotation register for measuring the degree of rotation of said shaft;

(c) a brake responsive to an applied voltage for applying a constant pre-determined torque resistance to said shaft corresponding to the amount of applied voltage;

(d) a device for selectively varying the amount of said voltage at a constant value such that said corresponding torque resistance is maintained at a constant value within a range useful for rehabilitation therapy; and (e) an accessory coupler on one end of said shaft for detachably receiving and supporting corresponding coupler elements of a plurality of tool simulator accessories of different frame and handle sizes and/or configurations.

8 Claims, 3 Drawing Sheets

APPARATUS FOR THE REHABILITATION OF DAMAGED LIMBS

DESCRIPTION OF THE INVENTION

This application is a continuation of Ser. No. 666,636 filed Oct. 31, 1984, now abandoned which has a divisional of Ser. No. 393,241 filed June 29, 1982 now abandoned which was a continuation-in-part of co-pending, commonly assigned U.S. patent application Ser. No. 099,838 filed Dec. 3, 1979 and now U.S. Pat. No. 4,337,050, the contents of which are incorporated by reference herein.

BACKGROUND ART

Briefly, my earlier application describes a method and apparatus for the rehabilitation of damaged limbs, particularly the upper extremities. The invention is based on the concept of applying a work simulator, analagous to the use of the famous Link Trainer for flight simulation during World War II, to the fields of diagnostic and rehabilitation physical therapy. By a combination of features which includes a series of interchangeable accessories of different sizes and configurations, each of which has at least one handle corresponding to the size and shape of the handle of a tool being simulated, e.g., common tools which are encountered around the house or on the job, successful rehabilitation therapy following impairment of the upper extremity is greatly facilitated and a rehabilitation program can be tailored to a particular patient's needs and rate of progress. The tool simulator accessories each have a coupler element and a frame interconnecting the handle to the coupler such that the movement of the handle through the path of movement of the tool handle being simulated produces rotation of the coupler element.

The coupler element is detachably mounted to a cooperative accessory coupler on the end of a brake controlled shaft mounted for full (360°) rotation in either direction about a fixed axis and controlled by a brake for applying a constant, pre-determined torque resistance to the shaft which can be selectively varied at a constant value over a range useful for rehabilitation therapy.

DISCLOSURE OF THE INVENTION

It is a general object of the present invention to provide improvements on the apparatus of my earlier copending application.

In one aspect, the present invention provides an improved means for attaching the torque arm associated with power grip and finger pinch tools to give both left and right hand operation, as well as different angles of mounting.

In another aspect, the present invention provides an improved means for coupling the tool simulator to the brake shaft which gives absolute locking of the tool in the shaft.

In yet another aspect, the present invention provides a series of tool simulator accessories for reproducing coordinated muscle movements.

BRIEF DESCRIPTION OF THE DRAWINGS

The above and other objects, features and advantages of the present invention will become more fully apparent to those skilled in the art to which this invention pertains from the following description taken in conjunction with the annexed drawings, wherein like or corresponding reference characters refer to like or corresponding parts in the various drawings, and in which.

BEST MODE FOR CARRYING OUT THE INVENTION

As in my earlier embodiment, it is important that the brake being used has the inherent characteristics of torque being constant for a given voltage setting (e.g. in the case of an electrical brake) over a therapeutically useful range of work loads. Because torque curves for electrical brakes of the type used in the work simulator are constant for a given voltage setting and vary only with differences in RPM, and because the differences in RPM for purposes of rehabilitation therapy are essentially insignificant (the torque curves are generally presented in increments of 100 RPM speed differences, while a patient undergoing therapy will seldom experience such a speed variation). In contradistinction to most prior art devices, which vary in resistance with speed, this enables a very precise control of resistance and avoids the very real danger of muscle damage which can be caused when resistance increases with increasing work applied against it, e.g. as in squeezing a rubber ball.

Figure 1:
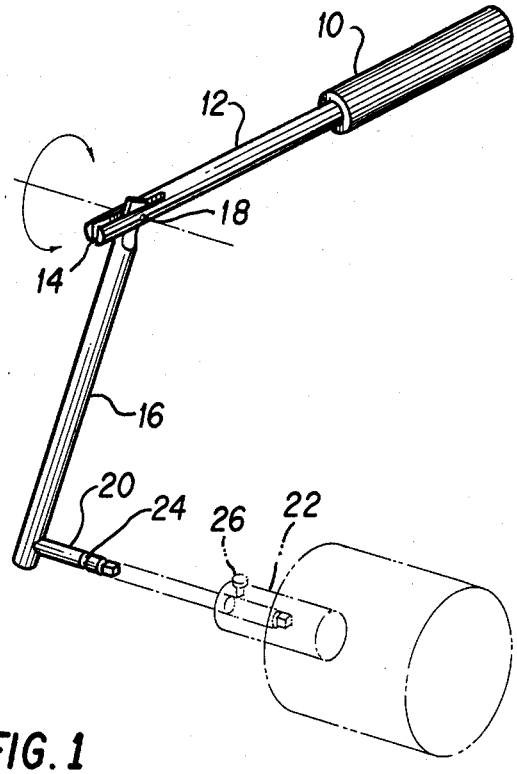
FIG. 1 is a partially schematic perspective view of an articulating tool simulator accessory with a cylindrical handle.

The newly developed tool simulators of the present invention are shownin in FIGS. 1–7 of the Drawings. FIG. 1 shows an articulating tool simulator accessory with a cylindrical handle and the improved locking device for detachably connecting the tool simulator accessory to the work simulator (shown in outline). The accessory comprises a gripping handle 10 affixed to one end of a rigid shaft 12 having a longitudinal slot 14 centrally formed at the opposite end thereof. A second shaft portion 16 is received by and pivotally attached to slot 14 by means of a suitable locking pin extending through corresponding apertures formed in both shaft locations. The opposite end of shaft is provided with an improved coupling element 20 for positively locking onto the accessory coupler 22 of the work simulator, with coupling element 20 having an annular groove 24 formed therein for receiving a spring-loaded plunger 26 on the accessory coupler.

Figure 2:
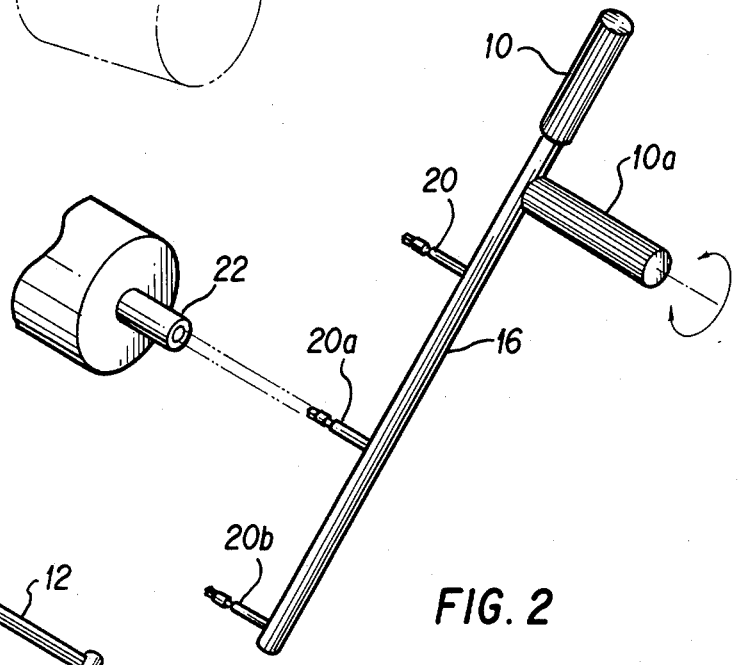
FIG. 2 is a perspective view of a three position bar tool simulator accessory have three extensions for modifying the degree of leverage employed.

FIG. 2 shows a three position bar tool simulator accessory having three extensions for modifying the degree of leverage employed. This device comprises two gripping handles 10, 10*a* which are affixed to a rigid shaft portion 16, with one of the handles being a longitudinal extension of the shaft portion and the other handle being affixed perpendicularly thereto. A plurality of coupling elements 20, 20*a*, 20*b* are spaced along shaft 16 so as to allow different leverage to be applied. Thus, for example, when a patient is just beginning therapy coupling element 20*b* (farthest from the handles) will be attached to accessory coupler 22 for maximal leverage and ease of operation. As the patient's therapy progresses, coupling elements 20*a* and 20 can be used to provide less leverage and therfore require more work.

Figure 3:
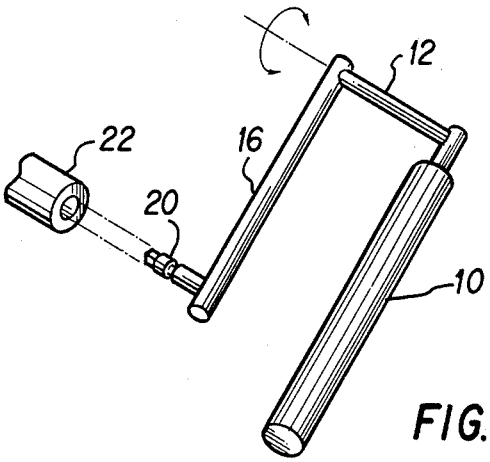
FIG. 3 is a similar view of a two-handed shoulder and elbow work simulator having a cylindrical handle.

FIG. 3 describes a two-handed shoulder and elbow work simulator having a large cylindrical handle 10 with a shaft 12 rigidly connected perpendicularly to its axis at the distal end thereof. The other end of shaft 12 is pivotally connected to shaft 16, which is perpendicular to shaft 12 and therefore parallel to handle 10. Coupling element 20 extends from the proximate end of shaft parallel to shaft 12.

Figure 4:
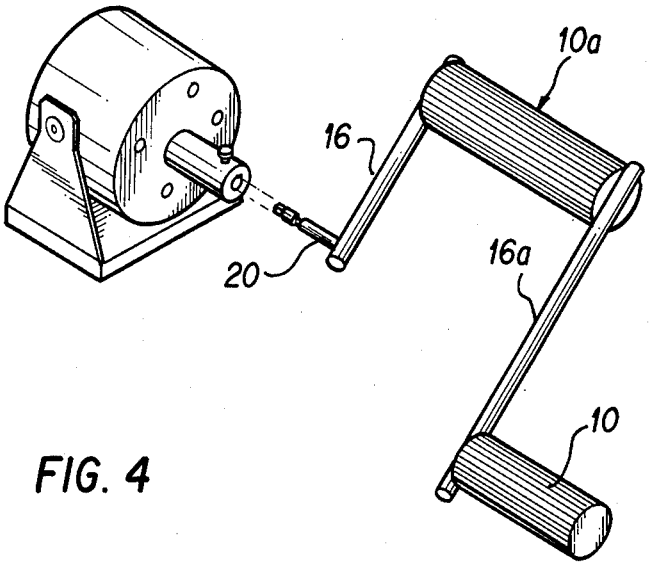
FIG. 4 is a similar view of a two-handed shoulder, elbow and wrist work simulator having a hand grip.

FIG. 4 illustrates a two-handled shoulder, elbow and wrist work simulator having a hand grip. This device comprises a pair of parallel spaced handles 10, 10*a* with a rigid shaft 16 connecting the internal handle 10*a* to accessory coupler 20 and a rigid shaft 16*a* connecting the internal handle 10*a* to the external handle 10, shafts 16 and 16*a* being parallel to each other and handles 10 and 10*a* being parallel to accessory coupler 20.

Figure 5:
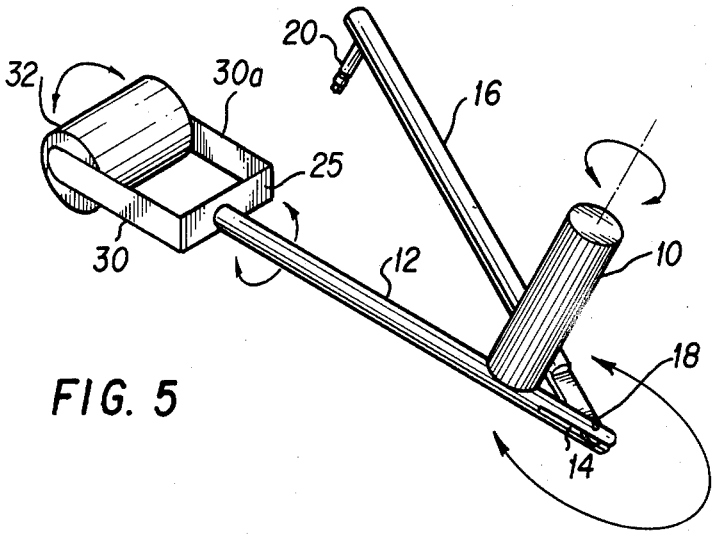
FIG. 5 is a perspective view of an articulating tool with a "T" handle.

FIG. 5 shows an articulating tool with a "T" handle consisting of a U-shaped member having a base 28 and two parallel sides 30, 30*a* with an elongated grip 32 rotatably disposed between sides 30 and 30*a* remote from the base, and the base 28 pivotally connected to elongated shaft 12 at one end thereof The other end of shaft 12 has a gripping handle 10 rotatably attached thereto perpendicular to its axis, and terminates with a longitudinal slot 14 centrally formed therein. A second shaft portion 16 is received by and pivotally attached to slot 14 by means of a suitable locking pin 18 extending through corresponding apertures formed in both shaft portions. Coupling element 20 is provided on the opposite end of shaft 16.

Figure 6:
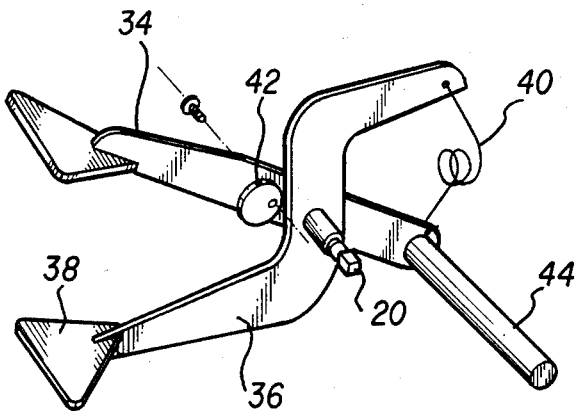
FIG. 6 is a similar view of a tool simulator accessory for three point prehension.
Figure 7:
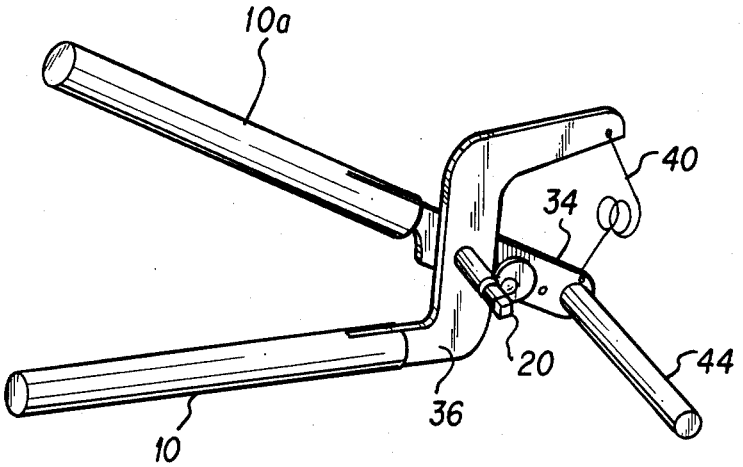
FIG. 7 is a similar view of a power grip simulator accessory.

FIG. 6 illustrates a tool simulator accessory for three point prehension, and FIG. 7 a similar device but with a different handle designed for power grip exercise. These simulators comprise a first essentially linear lever 34 articulating with a second, generally S-shaped lever 36 at essentially their respective mid points, from which coupling element 20 extends. One end of each lever has prehension handles 38 (FIG. 6) or gripping handles 10 (FIG. 7) attached thereto, while the other end of the linear lever has a torque arm 44 extending parallel to coupling element 20 for insertion into a corresponding slot of the work simulator housing (see FIG. 8) to provide for either left or right hand rotation and to provide the desired angle of mounting. A spring means 40 extends from near the point of attachment of positioning guide 44 on the linear lever to the corresponding end of the S-shaped lever 36, and stop means such as a rotatable cam 42 is provided on the linear lever proximate to its point of intersection with the S-shaped lever to engage the latter and limit movement of the levers with respect to each other.

Figure 8:
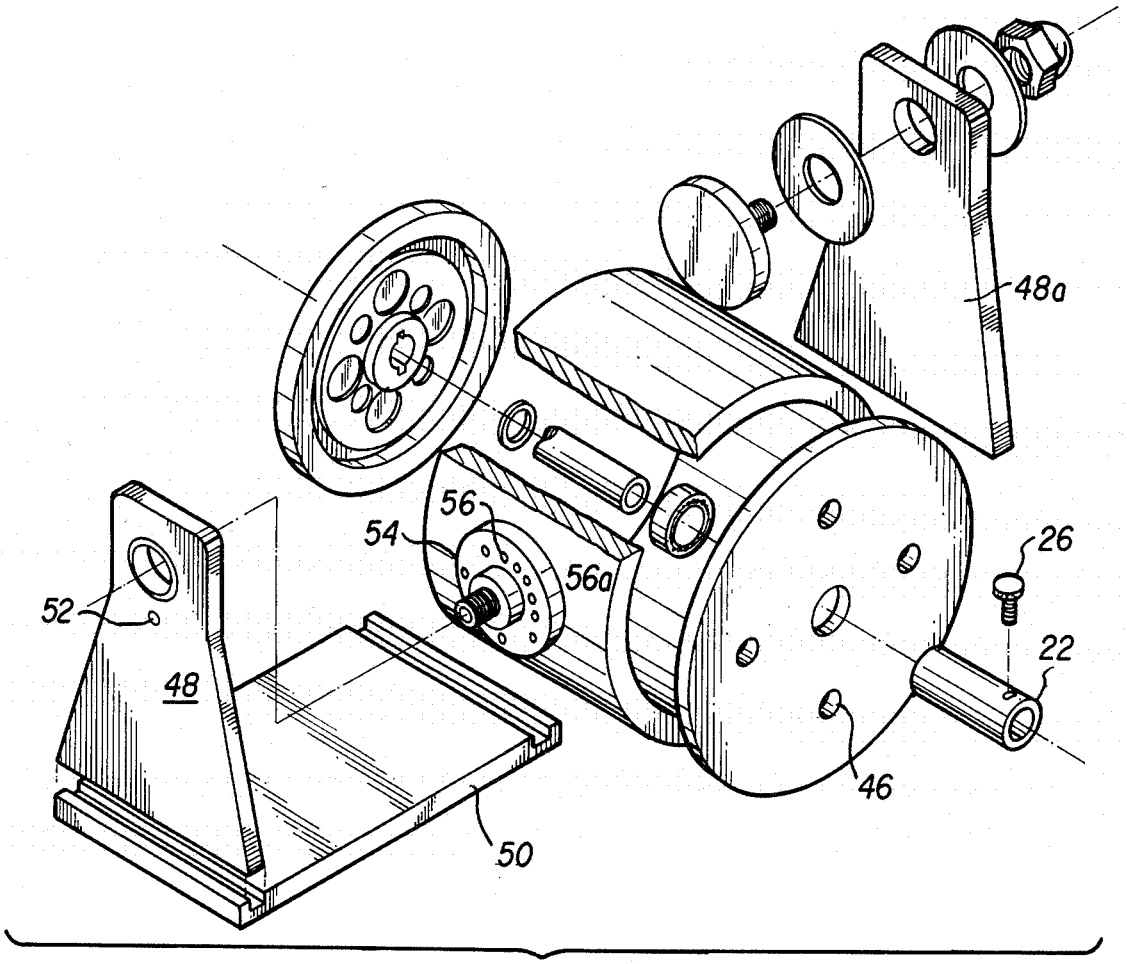
FIG. 8 is an exploded view of a work simulator of the present invention showing the improved locations for attaching the torque arm associated with a power grip tool and a finger pinch tool and the stub shaft method for positively locking the device at a desired degree of angular adjustment.

The manner of providing for either left or right hand rotation at a desired angle when using these tools can best be understood by reference to FIG. 8, which illustrates the improvded locations for attaching the torque arm associated with a power grip tool and a finger pinch tool and the stub shaft method for positively locking the device at a desired degree of angular adjustment. Regardless of the positioning of the tools, coupling element 20 positively locks onto the accessory coupler 22 of the work simulator, with coupling element 20 having an annular groove 24 formed therein for receiving a spring-loaded plunger 26 on the accessory coupler. A plurality of apertures 46, 46*a*, 46*b*, and 46*c* are formed in the face of the brake for receiving torque arm 44 at the desired angle and direction, so that either left-handed or right-handed therapy can be employed as desired.

FIG. 8 also illustrates an improved mounting method for anglular adjustment of the shaft and brake means. An elongated, generally U-shaped cradle comprising two side wall portions 48, 48*a* and a base portion 50 supports the work simulator. One of said side wall portions has an aperture 52 formed therein for receiving a removable locking key (not shown). The corresponding end of the work simulator has a flange 54 adjacent the bearing surface in which are fomred a plurality of corresponding apertures 56, 56*a* extending along an arc of approximately 90 degrees. The angle of the brake shaft can thus be positively set between horizontal and vertical by passing the locking key through the aperture 52 in the cradle and into the desired positioning aperture 56.

From the foregoing description, one skilled in the art to which this invention pertains can easily ascertain the essential characteristics thereof and, without departing from the spirit and scope of the present invention, can make various changes and modifications to adapt it to various usages and conditions.

What is claimed is:

1. Apparatus for simulating the operational characteristics of different tools in the rehabilitation therapy of damaged limbs by simultaneously carrying out, in coordinated fashion, several muscle and joint movements, which comprises:

(a) an angularity adjustable shaft mounted for full 360 degree rotation in either direction about a fixed axis;

(b) a rotation registering means for measuring the degree of rotation of said shaft;

(c) brake means for applying a constant pre-determined torque resistance to said shaft;

(d) means for selectively varying the torque resistance at a constant value within a range useful for rehabilitation therapy; and (e) an accessory coupler on one end of said shaft for detachably receiving and supporting corresponding coupler elements of a plurality of tool simulator accessories of different frame and handle sizes and/or configurations at any desired angle relative to said shaft each accessory being capable of simulating a series of successive limb, joint and muscle movement combinations and having a frame means interconnecting said coupler element with a tool simulating handle such that movement of said handle through the path of movement of its simulated tool rotates said coupler element and communicates such rotation to said shaft, whereby the work expended in overcoming said torque resistance in the course of said rehabilitation can be quantified.

2. An apparatus according to claim 1, wherein said accessory coupler includes a spring-loaded plunger for locking into a corresponding annular groove on said coupling element.

3. An apparatus according to claim 1, wherein said rotation registering means comprises a shaft rotation sensing assembly for sensing shaft rotation and for producing corresponding electrical signals indicative of shaft rotation.

4. An apparatus according to claim 1, wherein a plurality of receptacle holes are provided in the face of said brake, such that a torque arm of a tool simulator accessory can be inserted into any one of these holes, whereby both left and right hand operation as well as different angles of mounting are provided.

5. A method for providing rehabilitation therapy to injured limbs which comprises simulating the operational characteristics of different tools whose manipulation requires the use of said limbs, said simulation comprising carrying out simultaneously in coordinated fashion a plurality of muscle and joint movements using one or more tools simulator accessories of different frame and handle sizes and/or configurations, each accessory being capable of simulating a series of said successive limb, joint and muscle movement combinations and having a frame means interconnecting a corresponding coupler element of each of said accessories with a tool simulating handle such that movement of said handle through the path of movement of its simulated tool rotates said coupler element and communicates such rotation to an angularly adjustable shaft at any desired angle relative to said shaft whereby the work expended in overcoming the torque resistance of said shaft in the course of said rehabilitation can be quantified; said angularly adjustable shaft being mounted for full 360 degree rotation in either direction about a fixed axis and communicating with rotation registering means for measuring the degree of rotation on said shaft and brake means for applying said constant pre-determined torque resistance to said shaft such that said corresponding torque resistance is maintained at a constant value within a range useful for said rehabilitation therapy.

6. Apparatus for simulating the operational characteristics of different tools in the rehabilitation therapy by simultaneously carrying out, in coordinated fashion, several muscle and joint movements, which comprises:

(a) an angularly adjustable shaft mounted for full 360 degree rotation in either direction about a fixed axis;

(b) a rotation registering means for measuring the degree of rotation of said shaft;

(c) brake means for applying a resistance to said shaft within a range useful for rehabilitation therapy;

(d) an accessory coupler means on one end of said shaft for detachably receiving and supporting a corresponding coupler element of a tool simulator accessory, said accessory being capable of simulating a series of limb, joint and muscle movement combinations and defining a means interconnecting said coupler element with handle means to allow movement of said handle to rotate said coupler element and communicate rotation to said shaft, so that the work expended in overcoming said resistance in rotation of the shaft allows for rehabilitation.

7. Apparatus as claimed in claim 6 including means for selectively varying the shaft rotational resistance at a constant value within a range useful for rehabilitation therapy.

8. A method for providing rehabilitation therapy to injured limbs which comprises simulating the operational characteristics of different tools whose manipulation requires the use of said limbs, said simulation comprising carrying out simultaneously in coordinated fashion at least of a plurality of muscle and joint movements using one or more tools simulator accessories of different frame and handle sizes and/or configurations, each accessory being capable of simulating a series of said successive limb, joint and muscle movement combinations and having a frame means interconnecting a corresponding coupler element of each of said accessories with a tool simulating handle such that movement of said handle through the path of movement of its simulated tool rotates said coupler element and communicates such rotation to an angularly adjustable shaft whereby the work expended in overcoming the resistance of said shaft in the course of said rehabilitation can be quantified; said shaft being mounted for full 360 degree rotation in either direction about a fixed axis and communicating with rotation registering means for measuring the degree of rotation on said shaft and brake means for applying said resistance to said shaft such that said corresponding resistance is maintained at a value within a range useful for said rehabilitation therapy.

* * * * *

REEXAMINATION CERTIFICATE (1385th)

United States Patent [19]

[11] B1 4,768,783

Engalitcheff, Jr.

[45] Certificate Issued Nov. 13, 1990

[54] APPARATUS FOR THE REHABILITATION OF DAMAGED LIMBS

[75] Inventor: John Engalitcheff, Jr., Gibson Island, Md.

[73] Assignee: Baltimore Therapeutic Equipment Co., Hanover, Md.

Reexamination Request:
No. 90/001,896, Nov. 17, 1989

Reexamination Certificate for:

| | |
|---|---|
| Patent No.: | **4,768,783** |
| Issued: | **Sep. 6, 1988** |
| Appl. No.: | **900,242** |
| Filed: | **Aug. 26, 1986** |

Related U.S. Application Data

[60] Continuation of Ser. No. 666,636, Oct. 31, 1984, abandoned, which is a division of Ser. No. 393,241, Jun. 29, 1982, abandoned, which is a continuation-in-part of Ser. No. 99,838, Dec. 3, 1979, Pat. No. 4,337,050.

[51] Int. Cl.[5] ..... A63B 23/00

[52] U.S. Cl. ..... 272/143; 272/129; 272/130; 272/132; 272/DIG. 5; 128/25 R

[58] Field of Search ..... 272/67, 68, 117, 129, 272/130, 131, 132, 134, 143; 403/328; 128/28 R

[56] References Cited

U.S. PATENT DOCUMENTS

| | | | |
|---|---|---|---|
| 814,020 | 3/1906 | Clifford | 403/328 |
| 887,116 | 5/1908 | Palmer | 403/328 |
| 2,777,439 | 1/1957 | Tuttle | 272/132 |
| 3,495,824 | 2/1970 | Cuinier | 272/134 |
| 3,845,756 | 11/1974 | Olsson | 272/129 |
| 3,848,467 | 11/1974 | Flavell | 272/129 X |

FOREIGN PATENT DOCUMENTS 2045215 2/1971 France .

*Primary Examiner*—R. D. Bahr

[57] ABSTRACT

Apparatus for simulating the operational characteristics of different tools in the rehabilitation therapy of damaged limbs by simultaneously carrying out, in coordinated fashion, several muscle and joint movements, which comprises:

(a) an angularly adjustable shaft mounted for full rotation in either direction about a fixed axis;

(b) a rotation register for measuring the degree of rotation of said shaft;

(c) a brake responsive to an applied voltage for applying a constant pre-determined torque resistance to said shaft corresponding to the amount of applied voltage;

(d) a device for selectively varying the amount of said voltage at a constant value such that said corresponding torque resistance is maintained at a constant value within a range useful for rehabilitation therapy; and (e) an accessory coupler on one end of said shaft for detachably receiving and supporting corresponding coupler elements of a plurality of tool simulator accessories of different frame and handle sizes and/or configurations.

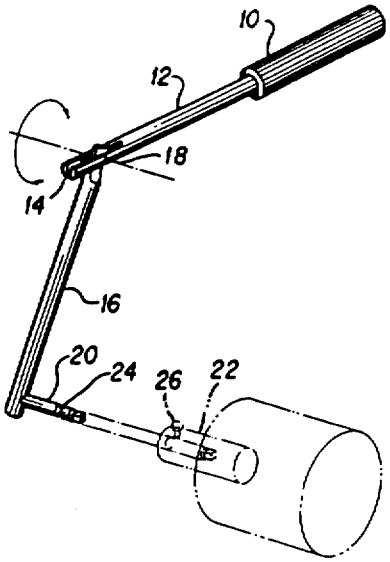

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1 through 8 is confirmed.

* * * * *